US012781978B2

(12) United States Patent
Thies

(10) Patent No.: US 12,781,978 B2
(45) Date of Patent: Nov. 3, 2026

(54) PROCESS GAS TREATMENT DEVICE AND METHOD FOR TREATING PROCESS GAS

(71) Applicant: Glatt Gesellschaft mit beschränkter Haftung, Binzen (DE)

(72) Inventor: Jochen Thies, Loerrach (DE)

(73) Assignee: Glatt Gesellschaft mit beschränkter Haftung, Binzen (DE)

( * ) Notice: Subject to any disclaimer, the term of this patent is extended or adjusted under 35 U.S.C. 154(b) by 395 days.

(21) Appl. No.: 17/940,707

(22) Filed: Sep. 8, 2022

(65) Prior Publication Data

US 2023/0071566 A1 Mar. 9, 2023

(30) Foreign Application Priority Data

Sep. 9, 2021 (DE) ..... 10 2021 209 959.9

(51) Int. Cl.

| | |
|---|---|
| ***F24F 3/00*** | (2006.01) |
| ***F24F 3/14*** | (2006.01) |
| ***F24F 3/153*** | (2006.01) |
| *F24F 110/20* | (2018.01) |

(52) U.S. Cl.

CPC ..... *F24F 3/1423* (2013.01); *F24F 3/153* (2013.01); *F24F 2110/20* (2018.01); *F24F 2203/1032* (2013.01); *F24F 2221/56* (2013.01)

(58) Field of Classification Search

CPC ..... F24F 3/1423; F24F 3/153; F24F 2110/20; F24F 2203/1032; F24F 2221/56; B01D 53/0454; B01D 2259/40007; B01D 53/26; B01D 53/261; B01D 53/06

USPC ..... 95/10

See application file for complete search history.

(56) References Cited

U.S. PATENT DOCUMENTS

| | | | | |
|---|---|---|---|---|
| 4,554,887 | A | 11/1985 | Yoakam et al. | |
| 5,170,633 | A | 12/1992 | Kaplan | |
| 5,509,275 | A * | 4/1996 | Bhatti | B60H 3/024 62/271 |
| 5,901,572 | A * | 5/1999 | Peiffer | B60H 1/32014 62/480 |
| 8,466,134 | B1 * | 6/2013 | Saidi | A61K 9/1075 514/172 |
| 8,580,010 | B2 | 11/2013 | Matsuba et al. | |
| 8,790,451 | B1 * | 7/2014 | Narayanamurthy | B01D 53/263 96/111 |
| 2003/0209141 | A1 * | 11/2003 | Wedge | B01D 53/268 95/45 |
| 2004/0084044 | A1 * | 5/2004 | Childers | A61M 15/025 128/200.14 |
| 2004/0099140 | A1 | 5/2004 | Hesse et al. | |
| 2005/0204914 | A1 * | 9/2005 | Boutall | B01D 53/06 96/112 |
| 2011/0226863 | A1 * | 9/2011 | Kagawa | F24F 6/00 236/44 A |

(Continued)

FOREIGN PATENT DOCUMENTS

| | | | |
|---|---|---|---|
| CN | 103977675 | A | 8/2014 |
| DE | 102018132274 | A1 | 6/2019 |

(Continued)

*Primary Examiner* — T. Bennett McKenzie
(74) *Attorney, Agent, or Firm* — The Webb Law Firm

(57) ABSTRACT

A process gas treatment device for a process gas for treating a process material in a process apparatus and a method for treating process gas for the treatment of a process material in a process apparatus during a drying phase and a cooling phase.

10 Claims, 7 Drawing Sheets

(56) References Cited

U.S. PATENT DOCUMENTS

| | | | | |
|---|---|---|---|---|
| 2012/0067205 | A1* | 3/2012 | Pendzich | B01D 53/265<br>95/17 |
| 2013/0273236 | A1* | 10/2013 | Reineccius | A01C 1/06<br>118/58 |
| 2014/0230480 | A1 | 8/2014 | Sakai et al. | |
| 2015/0182415 | A1* | 7/2015 | Olkowski | A61H 23/02<br>604/295 |
| 2016/0268593 | A1* | 9/2016 | Vogler | H01M 4/364 |
| 2018/0117994 | A1* | 5/2018 | David | A61L 9/14 |
| 2019/0145638 | A1* | 5/2019 | Alvey | E03B 3/28<br>62/94 |
| 2021/0291109 | A1* | 9/2021 | Sugiyama | B01D 53/229 |

FOREIGN PATENT DOCUMENTS

| | | | |
|---|---|---|---|
| JP | 2003302088 | A | 10/2003 |
| JP | 2012117683 | A | 6/2012 |
| JP | 201396605 | A | 5/2013 |
| JP | 2015188860 | A | 11/2015 |
| WO | 2012034147 | A1 | 3/2012 |
| WO | 2017034132 | A1 | 3/2017 |

* cited by examiner

PROCESS GAS TREATMENT DEVICE AND METHOD FOR TREATING PROCESS GAS

CROSS-REFERENCE TO RELATED APPLICATION

This application claims priority to German Patent Application No. 10 2021 209 959.9 filed Sep. 9, 2021, the disclosure of which is hereby incorporated by reference in its entirety.

BACKGROUND

Field

The invention relates to a process gas treatment device for a process gas for the treatment of a process material in a process apparatus.

Description of Related Art

Process gas treatment devices are known, but, in addition to a high energy consumption, also have long cooling times for the process gas.

SUMMARY

The invention relates to a process gas treatment device for a process gas for the treatment of a process material in a process apparatus, with a process gas inlet and a process gas outlet fluidically connected to the process apparatus, wherein the process gas flows on a treatment section extending from the process gas inlet to the process gas outlet, with a process gas dehumidifying device, designed as a device component, in flow direction of the process gas, and a process gas tempering device, designed as a device component, arranged downstream of the process gas dehumidifying device, wherein the process gas dehumidifying device has a dehumidifying device inlet and a dehumidifying device outlet and the process gas tempering device has a tempering device inlet and a tempering device outlet, and wherein the process gas tempering device has a tempering unit, designed as a device component, for the process gas having a tempering unit inlet and a tempering unit outlet, a cooling unit, designed as a device component, for the process gas having a cooling unit inlet and a cooling unit outlet, and has a bypass unit, designed as a device component, connected in parallel to the tempering unit having a bypass inlet and a bypass outlet, wherein a valve arrangement, designed as a device component, is arranged on the bypass unit for optional throughflow of the tempering unit or the bypass unit, and with a first measuring device having a relative humidity sensor for measuring the relative humidity of the process gas, wherein the first measuring device is arranged downstream of the process gas dehumidifying device and with a control device.

Furthermore, the invention relates to a method for treating process gas for the treatment of a process material in a process apparatus during a drying phase and a cooling phase having a process gas treatment device, with a process gas inlet and a process gas outlet fluidically connected to the process apparatus, wherein the process gas flows on a treatment section extending from the process gas inlet to the process gas outlet, with a process gas dehumidifying device, designed as a device component, in flow direction of the process gas and a process gas tempering device, designed as a device component, arranged downstream of the process gas dehumidifying device, wherein the process gas dehumidifying device has a dehumidifying device inlet and a dehumidifying device outlet and the process gas tempering device has a tempering device inlet and a tempering device outlet, and wherein the process gas tempering device has a tempering unit, designed as a device component, for the process gas, having a tempering unit inlet and a tempering unit outlet, a cooling unit, designed as a device component, for the process gas, having a cooling unit inlet and a cooling unit outlet, and having a bypass unit, designed as a device component, having a bypass inlet and a bypass outlet, connected in parallel to the tempering unit, wherein a valve arrangement, designed as a device component, for optional throughflow of the tempering unit or the bypass unit is arranged on the bypass unit, and with a first measuring device having a relative humidity sensor for measuring the relative humidity of the process gas, wherein the first measuring device is arranged downstream of the process gas dehumidifying device and with a control device.

Therefore, the object of the invention is to provide a process gas treatment device and a method for treating process gas in order to minimise the disadvantages of known process gas treatment devices, in particular the high energy consumption and the long cooling times for the process gas.

This object is achieved in a process gas treatment device of the type named at the outset in that the cooling unit is a constituent of the bypass unit. In addition to the advantage of clearly reduced energy consumption during the drying phase and the cooling phase of the process material, such a process gas treatment device also has the advantage that the cooling times for the process gas, which in particular is ambient air, are reduced in the cooling phase of the process material, subsequent to the drying phase, by arranging the cooling unit in the bypass unit. A cooling phase of the process material begins after the drying phase of the process material. The cooling phase is necessary for avoiding the "sweating out" of moisture, in particular in the form of water, from the treated process material, as this moisture can otherwise precipitate and lead to an undesired agglomeration of the process material in the process apparatus. In the known process gas treatment devices, cooling of the process gas takes place upstream or downstream of the process gas tempering device. In the case of cooling of the process gas taking place upstream or downstream of the process gas tempering device, all device components are also subjected to throughflow in the cooling phase and thus cooled chronologically before the process material which, e.g. due to the inert mass of the installed device components, is very energy- and cost-intensive.

In a development of the process gas treatment device relating to same, the process gas treatment device has a process apparatus designed as a device component, which apparatus is expediently designed as fluidising apparatus or as coating apparatus. Fluidising apparatus are e.g. designed as fluidised bed apparatus or spouted bed apparatus. Coating apparatus are e.g. coaters, in particular drum coaters.

Preferably, the process gas treatment device has a process gas conveying device designed as a device component. The advantage of such an embodiment of the process gas treatment device is that the process gas is conveyed, adjustably, on the treatment section by the process gas conveying device, in particular a fan, a vacuum pump or the like. In this regard, the process gas conveying device is expediently arranged upstream and/or downstream of the process apparatus.

According to a further development of the process gas treatment device, the process gas dehumidifying device has a condensation dehumidifying unit, designed as a device component, having a condensation dehumidifying unit inlet and a condensation dehumidifying unit outlet, and/or has an adsorption dehumidifying unit, designed as a device component, having an adsorption dehumidifying unit inlet and an adsorption dehumidifying unit outlet. Advantageously, both the condensation dehumidifying unit and adsorption dehumidifying unit are suitable for dehumidifying the process gas, wherein an improved and accurate adjustable dehumidification of the process gas is made possible by using the condensation dehumidifying unit and the adsorption dehumidifying unit in the process gas dehumidifying device. Both device components, or the combination thereof, are used depending on the quantity of moisture to be withdrawn from the process gas.

Expediently, the condensation dehumidifying unit is designed as a fluid-cooled condenser, wherein in particular cooling water, e.g. from a stretch of water nearby, is used as fluid. The condensation dehumidifying unit designed as a condenser is preferably dimensioned to cool the process gas to approx. 8° C. using cooling water. In so doing, the relative humidity of the process gas drops, whereby this is dried.

The condensation dehumidifying unit designed as a condenser is sufficiently dimensioned for the majority of methods for treating process gas.

For the case that the process gas dehumidifying device has a condensation dehumidifying unit and an adsorption dehumidifying unit, the condensation dehumidifying unit is arranged upstream of the adsorption dehumidifying unit, expediently on the treatment section. In so doing, the relative humidity of the process gas after flowing through the condensation dehumidifying unit can be adjusted precisely by the adsorption dehumidifying unit, wherein the adsorption dehumidifying unit is designed preferably as a drying wheel.

In particular, the adsorption dehumidifying unit has a regenerating unit, designed as a device component, having a regenerating unit inlet and a regenerating unit outlet, wherein a regenerating gas is conveyed by a regenerating gas conveying device, designed as a device component, having a regenerating gas conveying device inlet and a regenerating gas conveying device outlet, on a regenerating line extending from the regenerating unit inlet to the regenerating unit outlet and, in flow direction of the regenerating gas, flows through a regenerating gas heating device, designed as a device component having a regenerating gas heating device inlet and a regenerating gas heating device outlet and an adsorption dehumidifying unit having a regenerating gas inlet and a regenerating gas outlet. Expediently, a heat regeneration of the adsorption dehumidifying unit takes place. Upon heat regeneration, the regenerating gas is heated to a temperature of e.g. 160° C. or more, and fed through the adsorption dehumidifying unit to be regenerated, for regenerating a drying agent of the adsorption dehumidifying unit. The hot regenerating gas removes from the drying agent the moisture withdrawn from the process gas and releases this, expediently to the environment, preferably at the regenerating unit outlet. In this regard, the regenerating line is preferably designed as a closed circuit. Accordingly, such a closed circuit has the advantage that a regeneration of the adsorption dehumidifying unit can take place independently of the ambient conditions, i.e. for example without ambient air being sucked in.

According to a further embodiment of the process gas treatment device, the process gas dehumidifying device has a preheating unit, designed as a device component, having a preheating unit inlet and a preheating unit outlet, which expediently is arranged upstream of the condensation dehumidifying unit and/or of the adsorption dehumidifying unit. The preheating unit is used in particular as "frost protection heating" for the condensation dehumidifying unit. In the case that the regenerating line is designed as a closed circuit, the moisture absorbed during regeneration of the adsorption dehumidifying unit is precipitated out of the regenerating gas in the preheating unit.

Particularly preferably, the preheating unit is furthermore also associated with the regenerating unit, wherein the preheating unit is arranged on the regenerating line, designed as a closed circuit, upstream of the regenerating gas heating device and downstream of the regenerating gas conveying device, whereby the process gas is heated when flowing through the preheating unit and the regenerating gas is cooled when flowing through the preheating unit. The integration of the preheating unit designed as a heat source additionally increases the economic efficiency of the drying of the process gas.

The regenerating gas conveying device is also preferably arranged on the regenerating line downstream of the adsorption dehumidifying unit. Due to this arrangement of the regenerating gas conveying device, a preferred vacuum is produced on the regenerating line.

The first measuring device is more preferably arranged upstream of the process gas tempering device. Advantageously, the relative humidity in the process gas is measured and transmitted to the control device as a sensor signal by means of the first measuring device.

The humidity indicates the proportion of water vapour in the process gas; water in liquid form (e.g. rain, dew) does not count. The relative humidity indicates the proportion of the highest possible saturation, wherein 100% means that no more water vapour can be absorbed in the process gas. The absolute humidity indicates the mass of the water vapour per cubic metre of process gas. The higher the temperature, the more water vapour the process gas, in particular air, can absorb.

The relative humidity can be converted into absolute humidity using approximation formulae. There are different approximation formulae for this which are known in literature. A "simple" approximation formula for calculating the absolute humidity f in the unit g/m$^3$ from the relative humidity and temperature $$f = \frac{6.112 \cdot e^{\frac{(17.67 \times T)}{(T+243.5)}} \cdot rh \cdot 18.02}{(273.15 + T) \cdot 100 \cdot 0.08314}$$

achieves an accuracy with a deviation of at most 0.1% in the temperature range from −30° C. and 35° C. and normal atmospheric air pressure, wherein, in the formula, the temperature T is given in degrees Celsius, the relative air humidity rh in % and e is the base of the natural logarithm 2.71828. The more the temperature deviates from the aforementioned temperature range, the more imprecise the result of the conversion.

The temperature of the process gas is required to convert relative humidity into absolute humidity. Therefore, the first measuring device also has a temperature sensor for measuring the temperature of the process gas. Expediently, the temperature of the process gas is also measured and transmitted to the control device as a sensor signal.

Preferably, the relative humidity sensor and the temperature sensor of the first measuring device are designed as a structural unit.

The calculation of the absolute humidity, which is independent of the temperature, is made possible by means of the temperature and relative humidity of the process gas, expediently transmitted to the control device as a sensor signal. Converting into absolute humidity actual value in the first measuring device or in the control device.

According to a further development of the process gas treatment device, the tempering unit has a heating device, designed as a device component, having a heating device inlet and a heating device outlet. The heating device is advantageously suitable for treating the process gas in the drying phase of the treatment of the process material by cooling or heating. As a result, the temperature of the process gas, in particular in the form of ambient air, can be set to anything in the range of 5° C. to 250° C.

According to an additional development of the process gas treatment device, the process gas conveying device is arranged downstream of the process gas dehumidifying device and upstream of the process gas tempering device. Due to this arrangement of the process gas conveying device downstream of the process gas dehumidifying device, a preferred vacuum is produced on the treatment section.

Furthermore, in a development of the process gas treatment device, a second measuring device, having a relative humidity sensor for measuring the relative humidity of the process gas, is arranged upstream of the process gas dehumidifying device. Advantageously, the relative humidity in the process gas is measured at the process gas inlet and transmitted to the control device as a sensor signal by means of the second measuring device. As a result, regulation and/or control of each individual device component is made possible independent of the other device components.

The temperature of the process gas is required to convert relative humidity into absolute humidity. Therefore, the second measuring device also has a temperature sensor for measuring the temperature of the process gas. In particular, the temperature of the process gas measured at the second measuring device is also transmitted to the control device as a sensor signal.

The relative humidity sensor and the temperature sensor of the second measuring device are also expediently designed as a structural unit.

The temperature and relative humidity measured on the second measuring device are used to regulate and/or control the individual device components in the form of switching same off and/or on. In particular, the condensation dehumidifying unit, the adsorption dehumidifying unit, the preheating unit and/or the humidifying device are thus regulated an/or controlled correspondingly. Surprisingly, this timely, innovative and proactive regulation technique results in enormous energy savings, and an improved treatment of the process gas is achieved.

In a further embodiment of the process gas treatment device, this preferably has a humidifying device, designed as a device component, arranged in particular downstream of the process gas dehumidifying device and upstream of the process gas tempering device, which humidifying device has a humidifying device inlet and a humidifying device outlet. It is possible for the process gas to be humidified by the humidifying device and also to set humidities of the process gas, which are quantitatively higher than the humidities of the process gas entering the process gas treatment device at the process gas inlet. For this, the process gas is heated, by the preheating unit, to a temperature which makes it possible for the process gas to absorb moisture.

Additionally, the object is achieved in a method of the type named at the outset in that the cooling unit is a constituent of the bypass unit, and wherein the tempering unit is subjected to throughflow when treating the process material in the process apparatus in the drying phase and the bypass unit having the cooling unit is subjected to throughflow in the cooling phase. In addition to the advantage of clearly reduced energy consumption during the drying phase and the cooling phase of the process material, a method for treating process gas in a process gas treatment device, developed in this way also has the advantage that the cooling times for the process gas, which in particular is ambient air, are reduced in the cooling phase of the process material, subsequent to the drying phase, by arranging the cooling unit in the bypass unit. A cooling phase of the process material begins after the drying phase of the process material. The cooling phase is necessary for avoiding a "sweating out" of moisture, in particular in the form of water, from the treated process material, as this moisture can otherwise precipitate and lead to an undesired agglomeration of the process material in the process apparatus. In the known process gas treatment devices, cooling of the process gas takes place upstream or downstream of the process gas tempering device. In the case of cooling of the process gas taking place upstream or downstream of the process gas tempering device, all device components are also subjected to throughflow in the cooling phase and thus cooled chronologically before the process material which, e.g. due to the inert mass of the installed device components, is very energy- and cost-intensive. Due to the method, the process gas tempering device is not subjected to throughflow in the cooling phase, whereby the method is clearly more energy efficient than methods already known.

According to a further advantageous embodiment of the method, the humidity of the process gas flowing through the process gas treatment device is regulated, in particular at least during the drying phase. The humidity of the process gas can be regulated both by means of the relative humidity and also by means of the absolute humidity, wherein preferably it is regulated by means of the absolute humidity, as the absolute humidity is independent of the temperature of the process gas, unlike the relative humidity.

Preferably on this point, the first measuring device has a temperature sensor for measuring the temperature of the process gas, and a first absolute humidity comparison takes place between absolute humidity target value and absolute humidity actual value in the control device, wherein the absolute humidity actual value is determined from a relative humidity value measured by the relative humidity sensor of the first measuring device and a temperature value measured by the respective temperature sensor. The absolute humidity actual value is determined expediently in the first measuring device or in the control device. The control device transmits an absolute humidity control variable to the process gas dehumidifying device and/or the humidifying device taking into consideration the first absolute humidity comparison, in order to regulate the absolute humidity of the process gas. Expediently, the humidity is adjusted in a tolerance range of ±3% of the target value.

In this respect, the process gas is humidified by a humidifying device arranged in particular downstream of the process gas dehumidifying device and upstream of the process gas tempering device. Due to the humidifying device, it is possible to humidify the process gas and also set the humidities of the process gas which are quantitatively higher than the humidity of the process gas entering the process gas treatment device at the process gas inlet. For this, the process gas is heated, by the preheating unit, to a temperature which makes it possible for the process gas to absorb moisture. Due to the humidifying device, the method for treating a process gas for the treatment of a process material in a process apparatus, in particular a fluidising apparatus or a coating apparatus, is even more flexible.

According to a further development of the method, the process gas dehumidifying device has an adsorption dehumidifying unit having a regenerating unit, wherein the adsorption dehumidifying unit is at least partially regenerated by the regenerating unit. In this respect, the regenerating unit has a regenerating gas heating device heating a regenerating gas, with the result that the regenerating gas absorbs moisture when flowing through the adsorption dehumidifying unit, whereby the adsorption dehumidifying unit is at least partially dried and thereby regenerated. The adsorption dehumidifying unit dehumidifies the process gas—regardless of whether or not a condensation dehumidifying unit is upstream—such that the target value stored in the control device is achieved. This takes place in particular via an exact setting of the parameters which are important for this, such as temperature and relative humidity of the regenerating gas. In particular, the control device therefore regulates and/or controls the regenerating gas heating device on the basis of the balancing of actual value and target value. The regenerating gas regenerates the adsorption dehumidifying unit such that this can absorb precisely the quantity of moisture in order to dry the process gas to reach the target value stored in the control device correspondingly. For this, preferably, the regenerating gas flows through the adsorption dehumidifying unit in counterflow to the process gas.

Moreover, the process gas dehumidifying device has a preheating unit which is expediently arranged upstream of the condensation dehumidifying unit, wherein the preheating unit heats the process gas entering the process gas treatment device via the process gas inlet, in order to prevent the condensation dehumidifying unit from freezing or to heat the process gas for humidifying the process gas. The preheating unit is used in particular as "frost protection heating" for the condensation dehumidifying unit. In the case that the regenerating line is designed as a closed circuit, the moisture absorbed during regeneration of the adsorption dehumidifying unit is precipitated out of the regenerating gas in the preheating unit.

According to an additional development of the method, each device component of the process gas treatment device can be switched on and/or off. On this point, a second measuring device having a relative humidity sensor for measuring the relative humidity of the process gas and a temperature sensor for measuring the temperature of the process gas is arranged upstream of the process gas dehumidifying device, and a second absolute humidity comparison between absolute humidity target value and absolute humidity actual value takes place in the control device, wherein the absolute humidity actual value is determined from a relative humidity value measured by the relative humidity sensor of the second measuring device and a temperature value measured by the respective temperature sensor.

Expediently, the absolute humidity actual value is determined in the second measuring device or in the control device. For this, the control device can transmit an absolute humidity control variable to any device component taking into consideration the second absolute humidity comparison, in order to switch on and/or off the respective device component of the process gas treatment device.

On the basis of the absolute humidity comparison, the control device decides which device components of the process gas treatment device are switched on and/or off for dehumidifying the process gas. Hereinafter, absolute humidity target values are listed which are used in practice when operating the process gas treatment device:

- Dehumidification only via the condensation dehumidifying unit at an absolute humidity target value of greater than or equal to 8 g/m$^3$; adsorption dehumidifying unit switched off when present;
- Dehumidification only via the adsorption dehumidifying unit at an absolute humidity target value of less than 8 g/m$^3$; condensation dehumidifying unit switched off when present;
- Dehumidification via the condensation dehumidifying unit and via the adsorption dehumidifying unit at an absolute humidity target value of less than 8 g/m$^3$ and a difference between absolute humidity actual value and absolute humidity target value of greater than or equal to 6 g/m$^3$;
- Humidification via the humidifying device at an absolute humidity actual value of less than the absolute humidity target value.

The aforementioned absolute humidity target value is a value based on experience which can also differ from the aforementioned absolute humidity target value.

The process gas treatment device has a process gas conveying device designed as a device component, which process gas conveying device conveys the process gas on a treatment section extending from the process gas inlet to the process gas outlet. The advantage of such an embodiment of the method is that the process gas is conveyed, adjustably, on the treatment section by the process gas conveying device, in particular a fan, a vacuum pump or the like.

BRIEF DESCRIPTION OF THE DRAWINGS

The invention is explained in more detail below using the attached drawings. There is shown in FIG. 1 a first embodiment of a process gas treatment device, FIG. 2 a second embodiment of a process gas treatment device, FIG. 3 a third embodiment of a process gas treatment device, FIG. 4 a fourth embodiment of a process gas treatment device, FIG. 5 a fifth embodiment of a process gas treatment device, FIG. 6 a sixth embodiment of a process gas treatment device, and FIG. 7 a seventh embodiment of a process gas treatment device.

DETAILED DESCRIPTION

Figure 1:
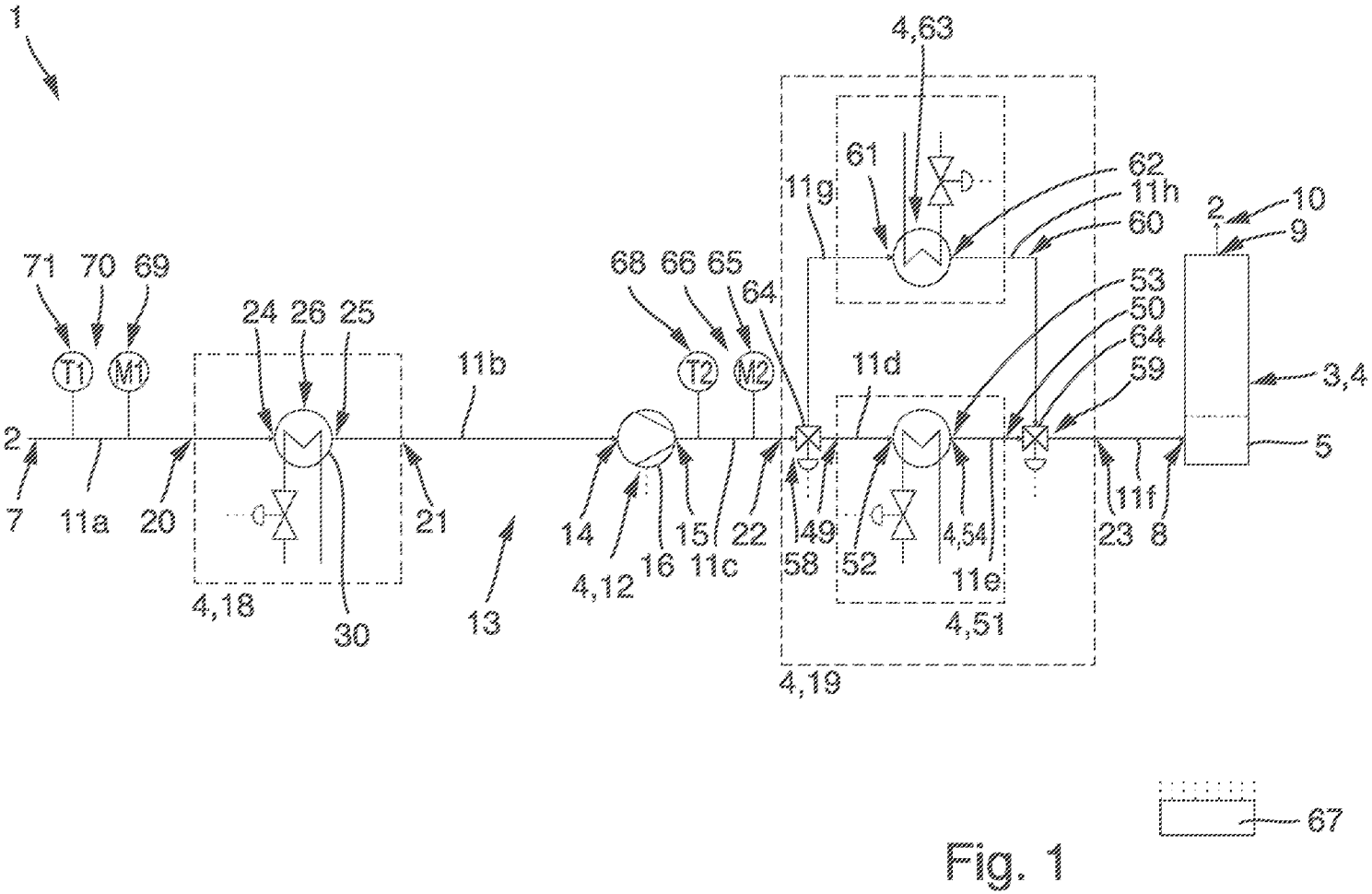

Provided that no statements are made to the contrary, the following description relates to all embodiments, illustrated in the drawings, of a preferred process gas treatment device 1 for a process gas 2 for the treatment of a process material in a process apparatus 3 and a corresponding method for treating process gas 2 for the treatment of a process material in a process apparatus 3. For this, the process gas treatment device 1 expediently has the process apparatus 3 designed as a device component 4, which apparatus is designed in particular as a fluidising apparatus 5 or as a coating apparatus 6.

The process gas treatment device 1 has a process gas inlet 7 and a process gas outlet 10 fluidically connected to the process apparatus 3 having a process apparatus inlet 8 and a process apparatus outlet 9. Preferably, process gas inlet 7 and process gas outlet 10 are designed as joints, on each of which delivering or continuing channel sections 11, expediently designed as piping, can be or are arranged. In order to better distinguish each of the similar items from one another, these are indicated on the reference signs below with a, b, c etc., e.g. channel section 11*a*, 11*b*, 11*c*.

Process gas 2 is conveyed, from a process gas conveying device 12 designed as a device component 4, on a treatment section 13 extending from the process gas inlet 7 to the process gas outlet 10. The process gas conveying device 12 having a process gas conveying device inlet 14 and a process gas conveying device outlet 15 is expediently designed as vacuum pump 16 or as fan 17. Preferably, process gas conveying device inlet 14 and process gas conveying device outlet 15 are designed as joints, on each of which delivering or continuing channel sections 11 can be or are arranged, wherein the channel sections 11 are designed in particular as piping.

In flow direction of the process gas 2, the process gas treatment device 1 has a process gas dehumidifying device 18, designed as a device component 4, and a process gas tempering device 19, designed as a device component 4, arranged downstream of the process gas dehumidifying device 18. Preferably, the process gas conveying device 12 is arranged downstream of the process gas dehumidifying device 18 and upstream of the process gas tempering device 19.

The process gas dehumidifying device 18 has a dehumidifying device inlet 20 and a dehumidifying device outlet 21 and the process gas tempering device 19 has a tempering device inlet 22 and a tempering device outlet 23. Preferably, the dehumidifying device inlet 20, dehumidifying device outlet 21, tempering device inlet 22 and tempering device outlet 23 are also designed as joints, on each of which delivering or continuing channel sections 11, in particular in the form of piping, can be or are arranged. Advantageously, the process gas dehumidifying device 18 can make possible an accurately adjustable dehumidification of process gas 2.

For this, the process gas dehumidifying device 18 has a condensation dehumidifying unit 26, designed as a device component 4, having a condensation dehumidifying unit inlet 24 and a condensation dehumidifying unit outlet 25, and/or has an adsorption dehumidifying unit 29, designed as a device component 4, having an adsorption dehumidifying unit inlet 27 and an adsorption dehumidifying unit outlet 28. Preferably, condensation dehumidifying unit inlet 24 and condensation dehumidifying unit outlet 25 as well as adsorption dehumidifying unit inlet 27 and adsorption dehumidifying unit outlet 28 are designed as joints, on each of which delivering or continuing channel sections 11, expediently designed as piping, can be or are arranged.

Figure 2:
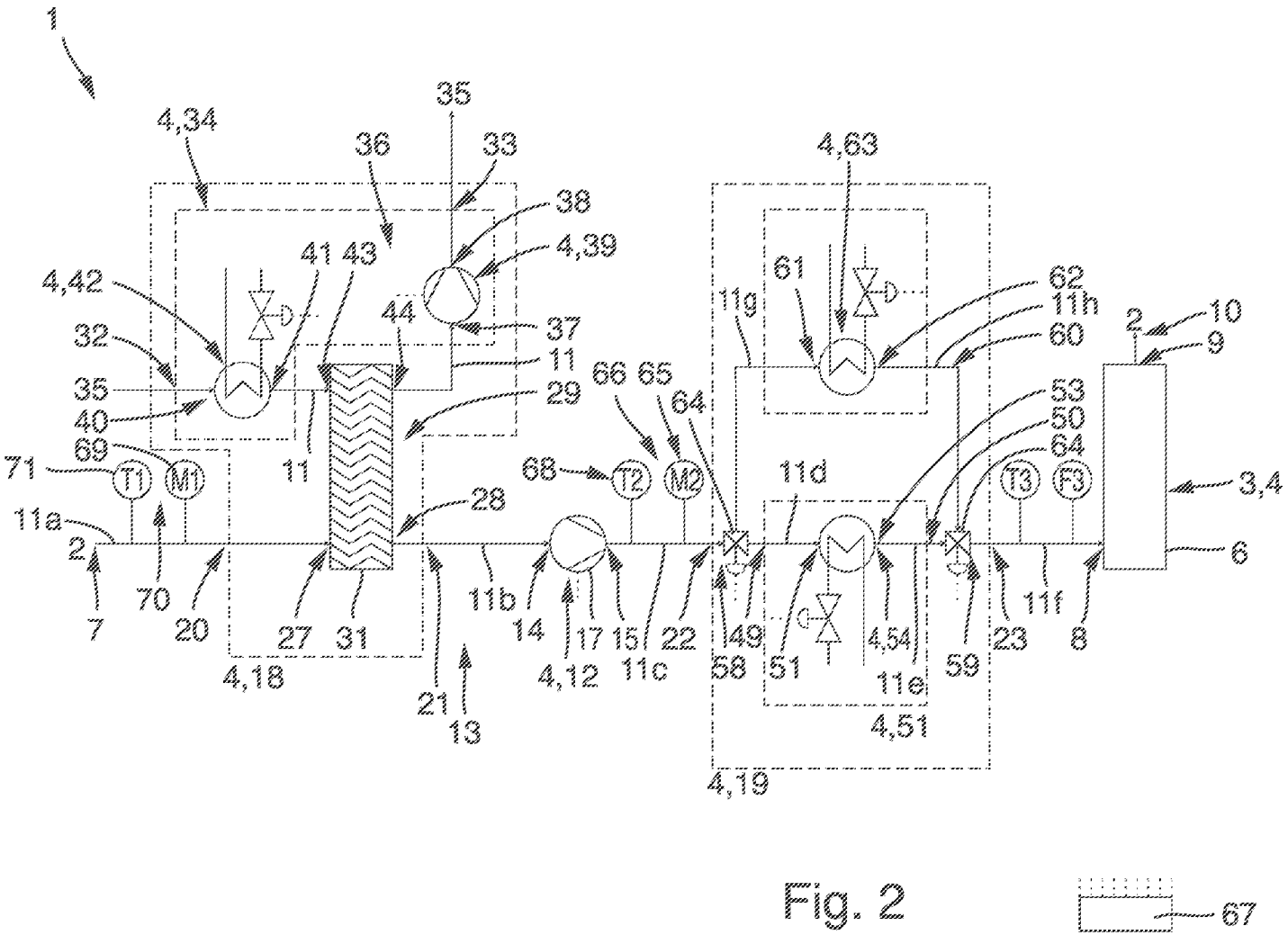

Apart from in the first embodiment of the process gas treatment device 1 shown in FIG. 1, in which the process gas dehumidifying device 18 has only the condensation dehumidifying unit 26, and in the embodiment shown in FIG. 2, in which the process gas dehumidifying device 18 has only the adsorption dehumidifying unit 29, in each of the other embodiments shown in FIGS. 3 to 7, the process gas dehumidifying device 18 has the condensation dehumidifying unit 26 and the adsorption dehumidifying unit 29 arranged downstream of the condensation dehumidifying unit 26 on the treatment section 13. Preferably, the condensation dehumidifying unit 26 is designed as a fluid-cooled condenser 30 and the adsorption dehumidifying unit 29 is designed as a drying wheel 31.

In the fluid-cooled condenser 30, in particular cooling water is used as fluid. The condenser 30 is in particular dimensioned so as to cool the process gas 2 to approx. 8° C. using cooling water, whereby the humidity of the process gas 2 drops. Such a condenser is sufficiently dimensioned for the majority of the methods for treating process gas 2 which have been carried out. The process gas 2 can also be cooled to a different temperature. The aforementioned 8° C. is an empirical value when using cooling water from the cold water system of operators of a process gas treatment device 1.

The embodiment shown in FIG. 2 shows an adsorption dehumidifying unit 29, designed as a process dehumidifying device 18, in the form of a drying wheel 31. The humidity of the process gas 2 can be adjusted accurately by the adsorption dehumidifying unit 29 designed as a drying wheel 31.

The humidity of the process gas 2 can be adjusted accurately by the adsorption dehumidifying unit 29 designed as a drying wheel 31 also in the embodiments of FIGS. 3 to 6. For this, in the embodiments shown in FIGS. 2 to 6, the adsorption dehumidifying unit 29 has a regenerating unit 34, designed as a device component 4, having a regenerating unit inlet 32 and a regenerating unit outlet 33. Preferably, regenerating unit inlet 32 and regenerating unit outlet 33 are designed as joints, on each of which delivering or continuing channel sections 11, expediently designed as piping, can be or are arranged.

To regenerate the adsorption dehumidifying unit 29, in particular the drying wheel 31, a regenerating gas 35 is conveyed, on a regenerating line 36 extending from the regenerating unit inlet 32 to the regenerating unit outlet 33, by a regenerating gas conveying device 39, designed as a device component, having a regenerating gas conveying device inlet 37 and a regenerating gas conveying device outlet 38. Expediently, regenerating gas conveying device inlet 37 and regenerating gas conveying device outlet 38 are also designed as joints, on each of which delivering or continuing channel sections 11, for example designed as piping, can be or are arranged. For this, in flow direction of the regenerating gas 35, throughflow of a regenerating gas heating device 42, designed as a device component 4, having a regenerating gas heating device inlet 40 and a regenerating gas heating device outlet 41, and an adsorption dehumidifying unit 29, having a regenerating gas inlet 43 and a regenerating gas outlet 44, takes place. Heat exchangers or electric heaters are in particular suitable as regenerating gas heating device 42. Preferably, regenerating gas heating device inlet 40 and regenerating gas heating device outlet 41, as well as regenerating gas inlet 43 and regenerating gas outlet 44, are also designed as joints, on each of which delivering or continuing channel sections 11, in particular in the form of piping, can be or are arranged. Expediently, the regenerating gas conveying device 39 is arranged on the regenerating line 36 downstream of the adsorption dehumidifying unit 29 and, more preferably, arranged simultaneously upstream of the process gas tempering device 19, whereby preferably a vacuum can be or is produced on the regenerating line 36.

Expediently, a heat regeneration of the adsorption dehumidifying unit 29 takes place. Upon heat regeneration, the regenerating gas 35 is heated to a temperature of e.g. 160° C. and fed through the adsorption dehumidifying unit 29 to be regenerated, for regenerating a drying agent of the adsorption dehumidifying unit 29. The hot regenerating gas 35 removes from the drying agent the moisture withdrawn from the process gas 2 and releases this, expediently to the environment, at the regenerating unit outlet 33.

Figure 3:
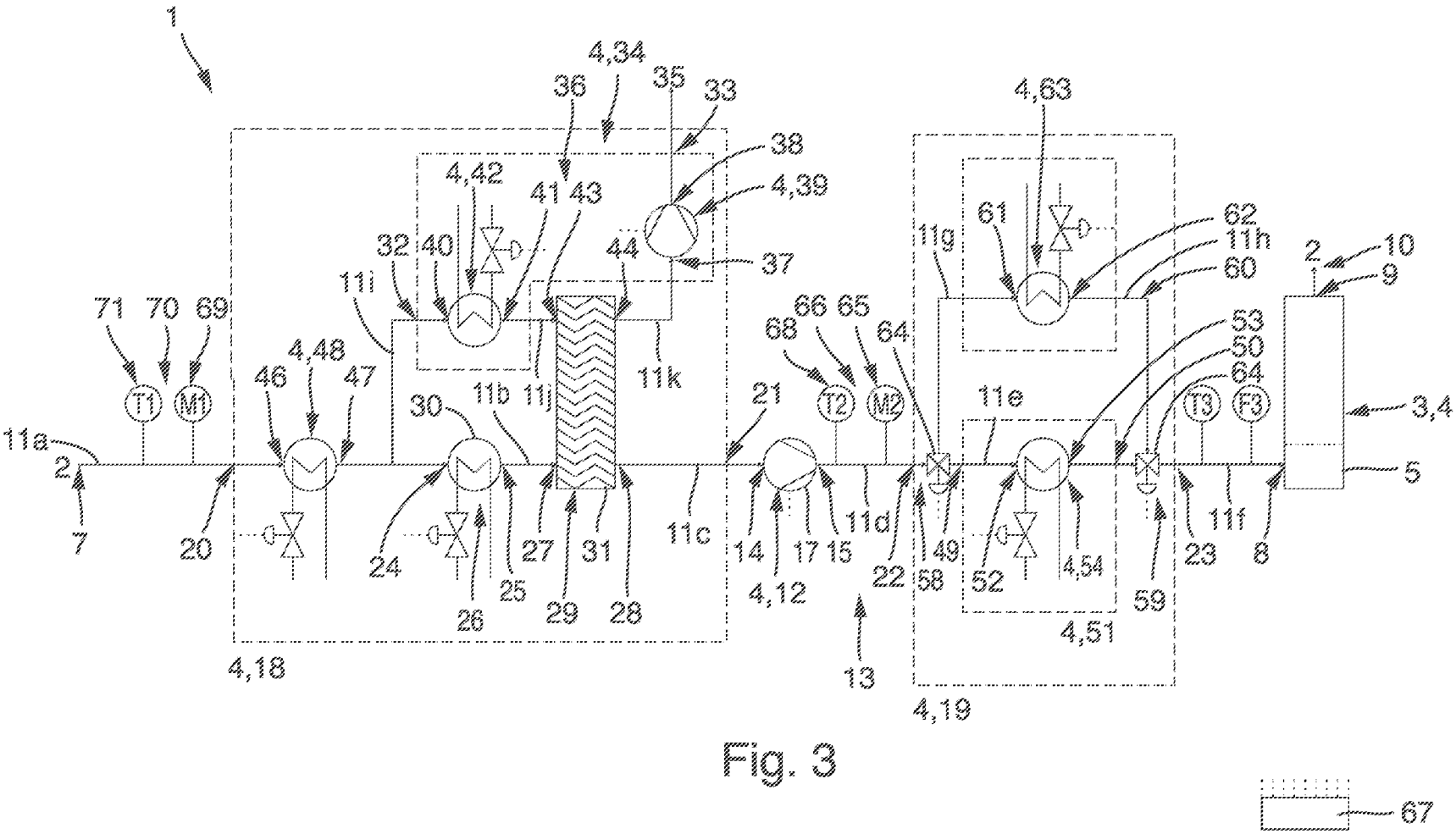

In the embodiment shown in FIG. 3, a portion of the process gas 2 which is diverted from the process gas 2 upstream of the condensation dehumidifying unit 26 is used as regenerating gas 35. After being diverted, the regenerating gas 35 flows in flow direction on the regenerating line 36 through regenerating gas heating device 42, the adsorption dehumidifying unit 29 and the regenerating gas conveying device 39, via the regenerating unit outlet 33, into the environment—thus leaving the regenerating unit 34 and with it the process gas treatment device 1.

Figure 4:
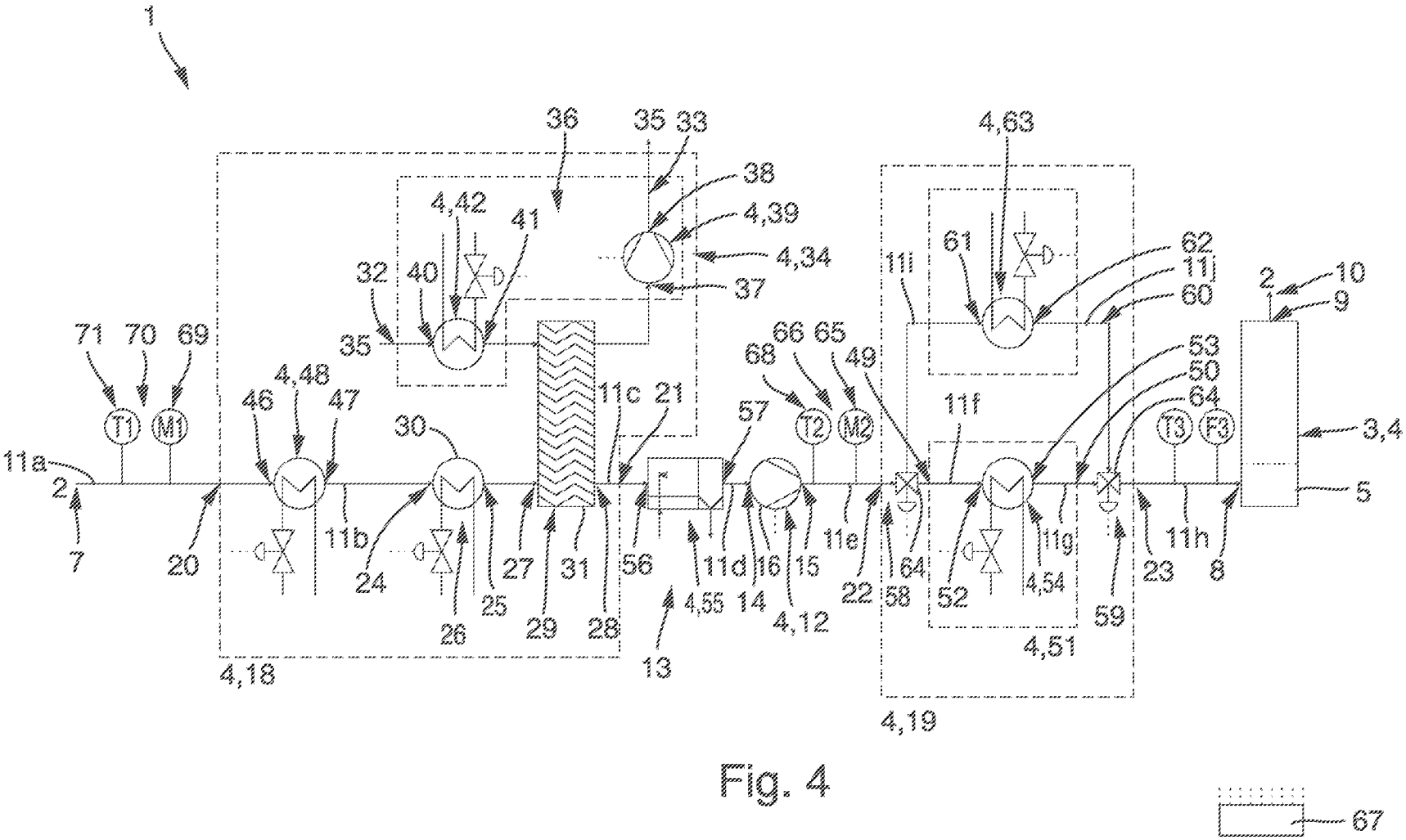

Unlike the embodiment shown in FIG. 3, in the embodiments shown in FIGS. 2 and 4, the regenerating gas 35 is not a portion of the process gas 2, but is withdrawn from ambient air.

Figure 5:
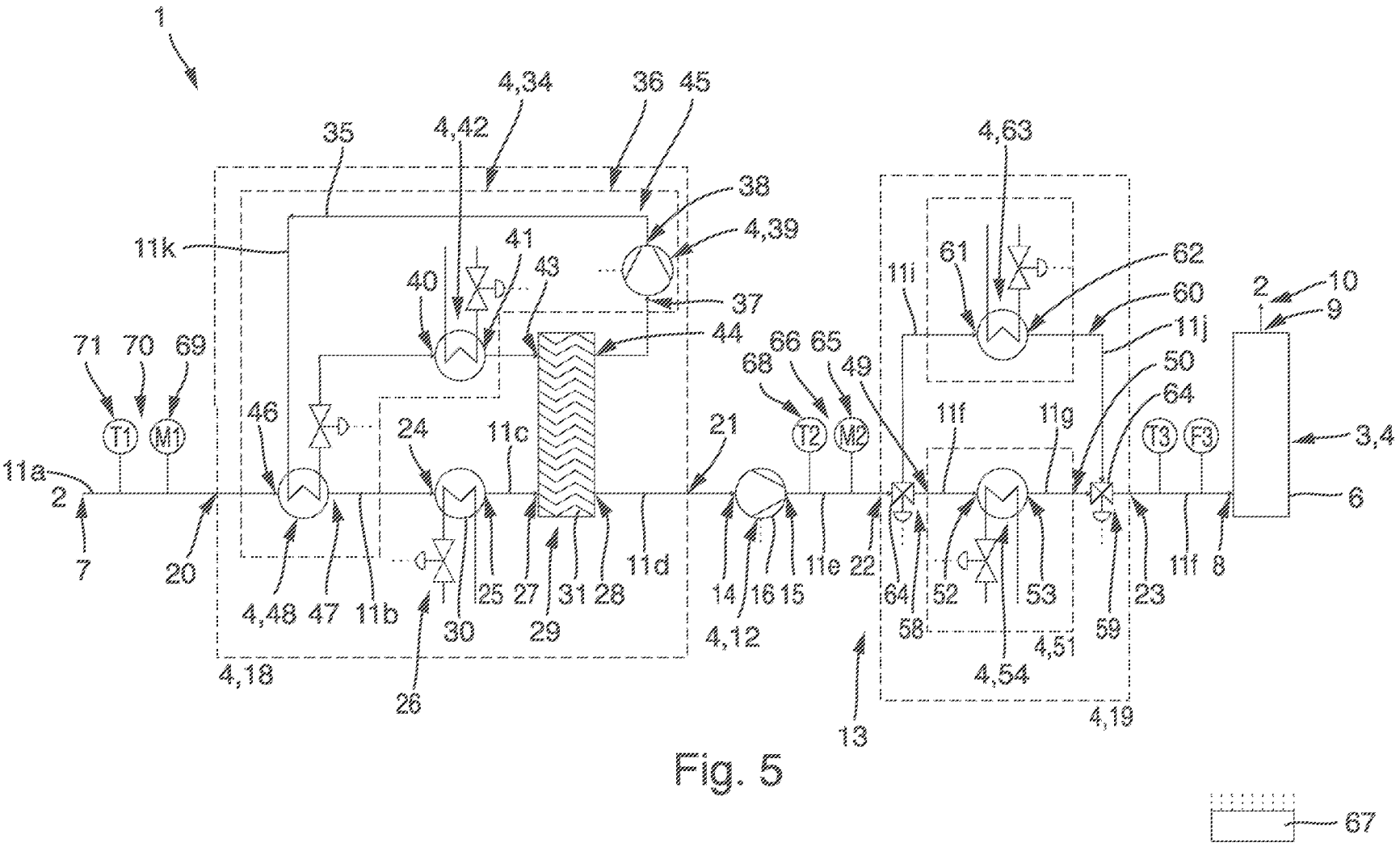
Figure 6:
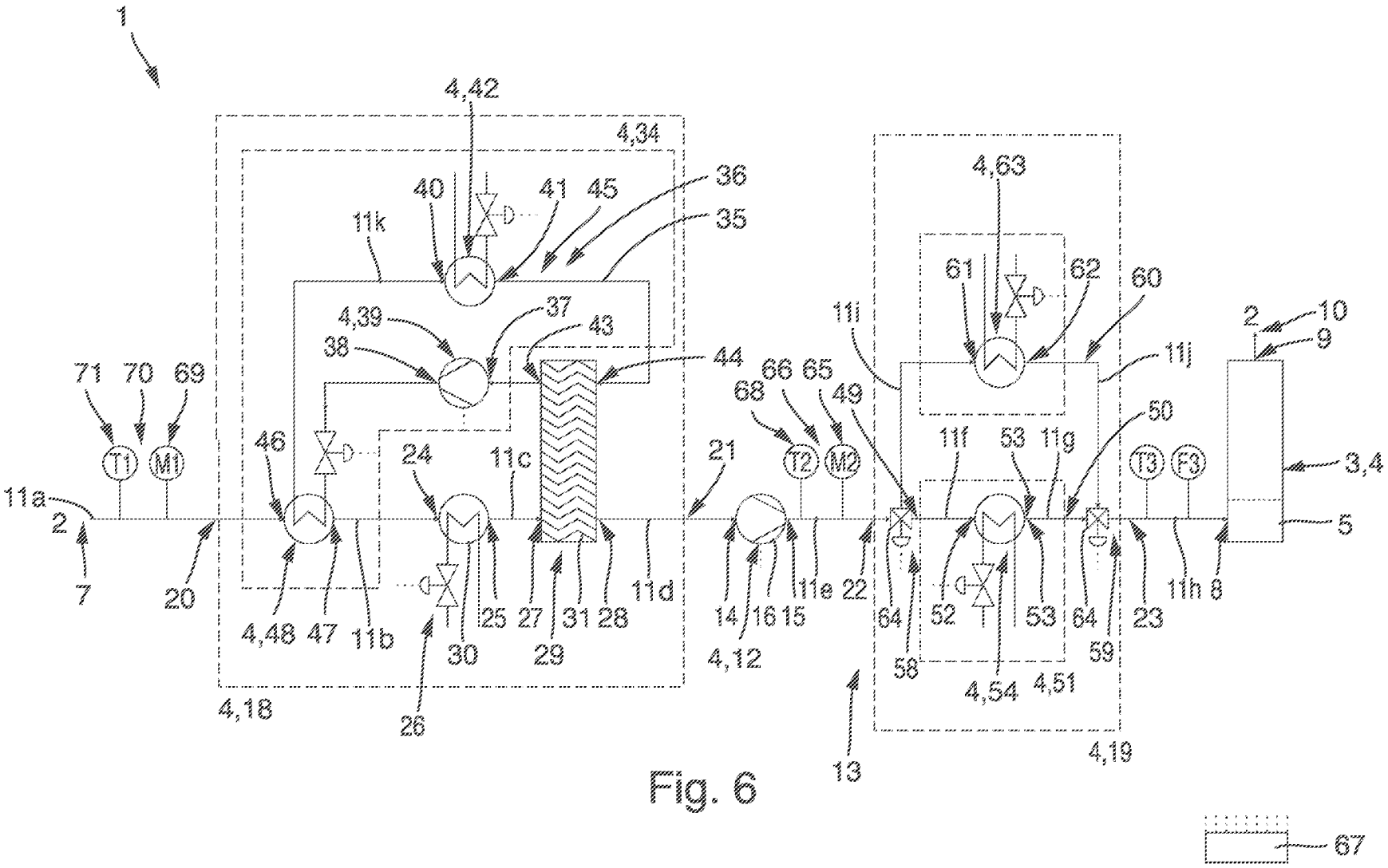

In the two embodiments described in FIGS. 5 and 6, the regenerating line 36 is designed as a closed circuit 45, unlike in the embodiments of FIGS. 2 to 4. In the fifth embodiment, shown in FIG. 5, the regenerating gas 35 flows in co-current flow through the adsorption dehumidifying unit 29 in respect of the process gas 2. In the sixth embodiment shown in FIG. 6, the process gas 2 and the regenerating gas 35 flow through the adsorption dehumidifying unit 29 in the counter flow principle. A closed circuit 45 has the advantage that a regeneration of the adsorption dehumidifying unit 29 can take place independent of ambient conditions, e.g. independently of the ambient temperature and ambient air.

Figure 7:
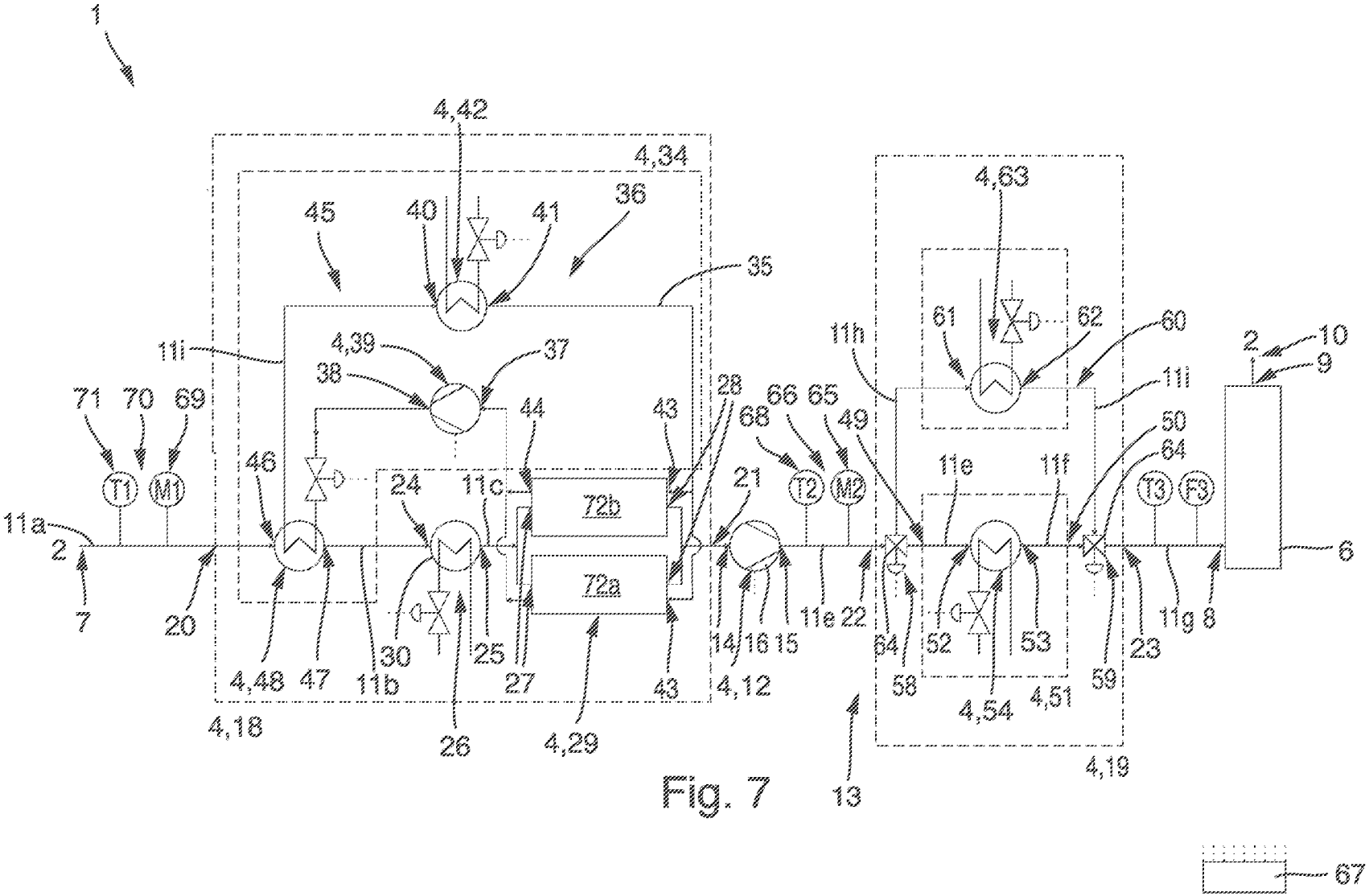

FIG. 7 shows a seventh embodiment of the process gas treatment device 1. For this, the adsorption dehumidifying unit 29 of the process gas dehumidifying device 18 has two containers 72*a* and 72*b*, each of which is filled with adsorbent. In each case, a container 72*a* or 72*b* is regenerated, hot or cold, by means of regenerating gas 35, while in each case the other container 72*a* or 72*b* is subjected to throughflow from process gas 2 and this dries to the desired humidity.

Additionally, the process gas dehumidifying device 18 has a preheating unit 48, designed as a device component 4, having a preheating unit inlet 46 and a preheating unit outlet 47. The preheating unit is used in particular as "frost protection heating" for the condensation dehumidifying unit 26 and is expediently arranged upstream of the condensation dehumidifying unit 26 and/or the adsorption dehumidifying unit 29. In the case that the regenerating line 36 is designed as a closed circuit 45, the moisture absorbed during regeneration of the adsorption dehumidifying unit 29 is precipitated out of the regenerating gas 35 in the preheating unit 48. In this respect, the preheating unit 48 is furthermore also advantageously associated with the regenerating unit 34, with the result that the preheating unit 48 is arranged upstream of the regenerating gas heating device 42 and downstream of the regenerating gas conveying device 39 on the regenerating line 36, designed as a closed circuit 45, whereby the process gas 2 is heated when flowing through the preheating unit 48 and the regenerating gas 35 is cooled when flowing through the preheating unit 48. Expediently, preheating unit inlet 46 and preheating unit outlet 47 are designed as a pipe connection, on each of which delivering or continuing channel sections 11, expediently designed as piping, can be or are arranged.

The process gas tempering device 19 has a tempering unit 51, designed as a device component 4, for the process gas 2, having a tempering unit inlet 49 and a tempering unit outlet 50. Expediently, tempering unit inlet 49 and tempering unit outlet 50 are designed as a pipe connection, on each of which delivering or continuing channel sections 11, expediently designed as piping, can be or are arranged. For this, the tempering unit 51 has a heating device 54, designed as a device component 4, having a heating device inlet 52 and a heating device outlet 53. Heating device inlet 52 and heating device outlet 53 are preferably also designed as a pipe connection, on each of which delivering or continuing channel sections 11, expediently designed as piping, can be or are arranged. The heating device 54 is advantageously suitable for treating the process gas 2 in the drying phase of the treatment of the process material by cooling or heating, in particular a temperature range of 10° C. to 250° C., preferably at least above ambient temperature, can be set.

Furthermore, the process gas treatment device 1 has a humidifying device 55, designed as a device component 4, arranged in particular downstream of the process gas dehumidifying device 18 and upstream of the process gas tempering device 19, which humidifying device has a humidifying device inlet 56 and a humidifying device outlet 57. Preferably, humidifying device inlet 56 and humidifying device outlet 57 are also designed as a pipe connection, on each of which delivering or continuing channel sections 11, expediently designed as piping, can be or are arranged. It is possible to humidify the process gas 2 by the humidifying device 55 and also to set relative humidities of the process gas 2, which are quantitatively higher than the process gas 2 entering the process gas treatment device 1 at the process gas inlet 7.

Furthermore, the process gas tempering device 19 has a bypass unit 60, designed as a device component 4, having a bypass inlet 58 and a bypass outlet 59 and connected in parallel to the tempering unit 51. In turn, the bypass unit 60 has a cooling unit 63, in particular a heat exchanger or the like, designed as a device component 4, for the process gas 2, having a cooling unit inlet 61 and a cooling unit outlet 62. Preferably, cooling unit inlet 61 and cooling unit outlet 62 are designed as a pipe connection, on each of which delivering or continuing channel sections 11, expediently designed as piping, can be or are arranged. A valve arrangement 64, designed as a device component 4, for optional throughflow of the tempering unit 51 or the bypass unit 60 is arranged on the bypass unit 60, wherein the cooling unit 63 is a constituent of the bypass unit 60. The bypass unit 60 is expediently designed as a channel section 11 in the form of a pipe connection. Expediently, two 3-way valves, or another valve arrangement 64 suitable for optional throughflow of the tempering unit 51 or the bypass unit 60, are used as valve arrangement 64.

The process gas treatment device 1 additionally has a first measuring device 66 having a relative humidity sensor 65 for measuring the relative humidity of the process gas 2, wherein the first measuring device 66 is arranged downstream of the process gas dehumidifying device 18. The relative humidity in the process gas 2 is measured by means of the relative humidity sensor 65 and transmitted, as actual value, to the control device 67 in the form of a sensor signal. The control device 67 is configured to regulate and/or control all device components 4 independently of one another. The respective inlets and outlets of the device components 4 are interconnected via channel sections 11, preferably in the form of piping, corresponding to the embodiments shown in FIGS. 1 to 7. Peripheral devices also arranged upstream of the process gas inlet 7 and downstream of the process gas outlet 10 can be connected via channel sections 11, preferably in the form of piping.

Moreover, the first measuring device 66 furthermore has a temperature sensor 68 for measuring the temperature of the process gas 2. Also, the temperature value is transmitted as an actual value for the temperature to the control device 67 in the form of a sensor signal. Expediently, the relative humidity sensor and the temperature sensor 68 of the first measuring device 66 are designed as a structural unit.

As already explained, the absolute humidity actual value of the process gas 2, the absolute humidity, is determined from the relative humidity of the process gas 2 measured at the relative humidity sensor 69 and the temperature measured at the temperature sensor 68. The absolute humidity actual value is determined in the first measuring device 66 or in the control device 67. For the case that the absolute humidity actual value is determined in the first measuring device 66, the absolute humidity actual value is transmitted to the control device 67 as a sensor signal.

The humidity, preferably the absolute humidity, of the process gas 2 flowing through the process gas treatment device 1, is regulated by the control device 67 in conjunction with the first measuring device 66. Advantageously, the humidity is regulated at least during the drying phase. Regulation takes place either on the basis of the relative humidity or the absolute humidity, wherein regulation on the basis of absolute humidity is preferred, as this does not depend on the temperature.

For this, a first absolute humidity comparison takes place in the control device 67 between an absolute humidity target value stored in the control device 67 and the absolute humidity actual value, wherein the absolute humidity actual value, as described, is determined from a relative humidity value measured from the relative humidity sensor 65 of the first measuring device 66 and a temperature value measured by the respective temperature sensor 68.

Taking into consideration the first absolute humidity comparison, the control device 67 subsequently transmits an absolute humidity control variable to the process gas dehumidifying device 18 in order to regulate the absolute humidity of the process gas 2.

There are various possibilities for drying to a lower moisture level, wherein drying by means of condensation dehumidifying unit 26 is limited by the cooling water. The adsorption dehumidifying unit is limited by the capacity of the drying means, wherein an increase in moisture can be set by regenerating the drying means.

The absolute humidity of the process gas 2 is set by means of the process gas dehumidifying device 18 regulated by the control device 67 such that the corresponding absolute humidity actual value and absolute humidity target value for the absolute humidity match, expediently in a tolerance range of less than or equal to 3%. The aforementioned applies to the relative humidity.

In the case that, in the absolute humidity comparison, the absolute humidity actual value is smaller than the absolute humidity target value, the process gas 2 is humidified. For this, the process gas 2 is heated expediently by the preheating unit 48, with the result that the temperature of the process gas 2 makes possible the absorption of the moisture to be supplied. The moisture is then supplied to the process gas by means of humidifying device 55. Expediently, for this, the first measuring device 66 is also arranged upstream of the process gas tempering device 19.

Additionally, a second measuring device 70 for measuring the relative humidity of the process gas 2 via a relative humidity sensor 69 is arranged upstream of the process gas dehumidifying device 18. The relative humidity in the process gas 2 is measured by means of the relative humidity sensor 69, and transmitted to the control device 67 as a further actual value, in the form of a sensor signal.

The second measuring device 70 also preferably has a temperature sensor 71 for measuring the temperature of the process gas 2, wherein the relative humidity sensor 69 and the temperature sensor 71 of the second measuring device 70 are expediently designed as a structural unit. For the case that the absolute humidity actual value is determined in the second measuring device 70, the absolute humidity actual value is transmitted to the control device 67 as a sensor signal.

Each device component 4 of the process gas treatment device 1 can be switched on and/or off via a second regulation and/or control taking place on the basis of the second measuring device 70.

For this, a second measuring device 70, having a relative humidity sensor 69 for measuring the relative humidity of the process gas 2 and a temperature sensor 71 for measuring the temperature of the process gas 2, is arranged upstream of the process gas dehumidifying device 1, and a second absolute humidity comparison takes place between an absolute humidity target value stored in the control device 67, which expediently differs from the absolute humidity target value for regulating the humidity, and an absolute humidity actual value, wherein the absolute humidity actual value is determined from a relative humidity value measured from the relative humidity sensor 69 of the second measuring device 70 and a temperature value measured by the respective temperature sensor 71.

The absolute humidity actual value is preferably determined in the second measuring device 70 or in the control device 67.

Taking into consideration the second absolute humidity comparison, the control device 67 transmits an absolute humidity control variable to each device component 4 in order to switch on and/or off the respective device component 4 of the process gas treatment device 1. For this, it is possible to switch on and/or off every individual device component 4 when the process is running, but in particular the condensation dehumidifying unit 26 and/or the adsorption dehumidifying unit 29 and/or the humidifying device 55. Surprisingly, this timely, innovative and proactive regulation and/or control technique results in enormous energy savings, and an improved treatment of the process gas 2 is achieved, in particular in respect of the temperature and humidity.

Regulating and/or controlling the device components 4 can, as described above, be based on the absolute humidity but equally also on relative humidity. Preferably, regulating and/or controlling is also here using absolute humidity, as this does not depend on temperature. Expediently, in a tolerance range of less than or equal to 3%.

The method for treating process gas 2 for the treatment of a process material in a process apparatus 3 in the process treatment device 1 runs as explained in more detail below:

Treating the process gas 2 for the treatment of the process material in the process apparatus 3, in particular a fluidising apparatus 5 or a coating apparatus 6, is divided into two successive method phases, specifically a drying phase and a cooling phase. The cooling phase of the process material thus takes place at the end of each treatment of the process material. This is necessary for avoiding the "sweating out" of moisture, in particular in the form of water, from the treated process material, as the moisture can otherwise precipitate and leads, or can lead, to an undesired agglomeration of the process material in the process apparatus 3. Therefore, when treating the process material in the process apparatus 3 in the drying phase, the tempering unit 51 of the process gas tempering device 19 is subjected to throughflow, and in the cooling phase, the bypass unit 60 having the cooling unit 63 is subjected to throughflow. When the tempering unit 51 is subjected to throughflow, the bypass unit 60 is not subjected to throughflow, and vice versa. As a result, in addition to the advantage of clearly reduced energy consumption during the whole treatment of the process material, the method for treating process gas 2 in a process gas treatment device 1 also has the advantage that the cooling times for the process gas 2, which in particular is ambient air, are reduced in the cooling phase of the process material, subsequent to the drying phase, by arranging the cooling unit 63 in the bypass unit 60. The process material can also be cooled more quickly and with greater energy efficiency as a result.

During the treatment of the process material in the process apparatus 3, the process gas 2 enters the process treatment device 1 at the process gas inlet 7 and flows through same, as well as the process apparatus 3 subsequent to the process treatment device 1. As a result, the process gas 2 is conveyed by the process gas conveying device 12. In addition to the process gas dehumidifying device 18 and the process gas tempering device 19, the process gas 2 also flows through a humidifying device 55, arranged optionally in particular downstream of the process gas dehumidifying device 18 and upstream of the process gas tempering device 19. The humidifying device 55 makes it possible for the process gas 2 to be humidified and also to set relative humidities of the process gas 2, which are quantitatively higher than the process gas 2 entering the process gas treatment device 1 at the process gas inlet 7. If the humidifying device 55 is used, the process gas 2 is heated expediently, before being humidified, by the preheating unit 48 to a temperature which ensures that the process gas 2 can absorb the moisture supplied by the humidifying device 55.

In the method, the humidity of the process gas 2 flowing through the process gas treatment device 1 is regulated, in particular at least during the drying phase. The humidity of the process gas 2 can be regulated both by means of the relative humidity and also by means of the absolute humidity, wherein it is preferably regulated by means of the absolute humidity, as, unlike the relative humidity, the absolute humidity does not depend on the temperature of the process gas 2.

Preferably on this point, the first measuring device 66 has the relative humidity sensor 65 for measuring the relative humidity of the process gas 2 and the temperature sensor 68 for measuring the temperature of the process gas 2. The relative humidity value and the temperature value are transmitted to the control device 67 as sensor signals.

A first absolute humidity comparison takes place in the control device 67 between the stored absolute humidity target value and absolute humidity actual value, wherein the absolute humidity actual value is determined from a relative humidity value measured by the relative humidity sensor 65 of the first measuring device 66 and a temperature value measured by the respective temperature sensor 68. The absolute humidity actual value is determined expediently in the first measuring device 66 or in the control device 67. Taking into consideration the first absolute humidity comparison, the control device 67 transmits an absolute humidity control variable to the process gas dehumidifying device 18 in order to regulate the absolute humidity of the process gas 2. Expediently, the humidity is adjusted in a tolerance range of ±3% of the target value.

Also, a humidification which can be carried out takes place via regulation by means of the first measuring device 66, as already explained above.

If the process gas dehumidifying device 18 has an adsorption dehumidifying unit 29, designed in particular as a drying wheel 31, for drying the process gas 2, this then has a regenerating unit 34 which at least partially regenerates the adsorption dehumidifying unit 29. Such process gas dehumidifying devices 18 are shown i.a. in FIGS. 2 to 7.

Upstream of the adsorption dehumidifying unit 29, the regenerating gas 35 flows through the regenerating gas heating device 42, which dries and heats the regenerating gas 35, with the result that the regenerating gas 35 can absorb the moisture of the adsorption dehumidifying unit 29. The regenerating gas 35 is dried and heated here to such an extent that the adsorption dehumidifying unit 29 dries, or can dry, the process gas 2 likewise flowing through the adsorption dehumidifying unit 29 to an established relative humidity. In particular, the control device 67 therefore regulates and/or controls the regenerating gas heating device 42 on the basis of the first absolute humidity comparison between the stored absolute humidity target value and absolute humidity actual value. For this, preferably, the regenerating gas 35 flows through the adsorption dehumidifying unit 29, as shown in FIG. 6, in counter flow to process gas 2.

Moreover, the process gas dehumidifying device 18 has a preheating unit 48 which is expediently arranged upstream of the condensation dehumidifying unit 26, wherein the preheating unit 48 heats the process gas 2 entering the process gas treatment device 1 via the process gas inlet 7, in order to prevent the condensation dehumidifying unit 26 from freezing. The preheating unit 48 is used in particular as "frost protection heating" for the condensation dehumidifying unit 26. In the case that the regenerating line 36 is designed as a closed circuit 45, the moisture absorbed during regeneration of the adsorption dehumidifying unit 29 is precipitated out of the regenerating gas 35 in the preheating unit 48.

Each individual device component 4 of the process gas treatment device 1 can be switched on and/or off. For this, a second measuring device 70 is arranged upstream of the process gas dehumidifying device 18 having a relative humidity sensor 69 for measuring the relative humidity of the process gas 2 and a temperature sensor 71 for measuring the temperature of the process gas 2. A second absolute humidity comparison between absolute humidity target value and absolute humidity actual value of the second measuring device 70 takes place in the control device, wherein the absolute humidity actual value is determined from a relative humidity value measured by the relative humidity sensor 69 of the second measuring device 70 and a temperature value measured by the respective temperature sensor 71. Expediently, the absolute humidity actual value is determined in the second measuring device 70 or in the control device 67. For this, the control device 67 transmits an absolute humidity control variable to each device component 4, taking into consideration the second absolute humidity comparison, in order to switch on and/or off the respective device component 4 of the process gas treatment device 1. Surprisingly, this timely, innovative and proactive regulation technique results in enormous energy savings, and an improved treatment of the relative humidity and temperature of the process gas 2 is achieved. Expediently, system operation costs are clearly reduced by switching on or off the device components 4.

On the basis of the absolute humidity comparison, the control device 67 decides which device components 4 of the process gas treatment device 1 are switched on and/or off to dehumidify the process gas 2. Hereinafter, absolute humidity target values are listed which are used in practice when operating the process gas treatment device 1:

Dehumidification only via the condensation dehumidifying unit 26 at an absolute humidity target value of greater than or equal to 8 g/m$^3$; adsorption dehumidifying unit 29 switched off when present;

Dehumidification only via the adsorption dehumidifying unit 29 at an absolute humidity target value of less than 8 g/m$^3$; condensation dehumidifying unit 26 is switched off when present;

Dehumidification via the condensation dehumidifying unit 26 and via the adsorption dehumidifying unit 29 at an absolute humidity target value of less than 8 g/m$^3$ and a difference between absolute humidity actual value and absolute humidity target value of greater than or equal to 6 g/m$^3$;

Humidification via the humidifying device 55 at an absolute humidity actual value of less than the absolute humidity target value.

The invention claimed is:

1. A process gas treatment device for a process gas for the treatment of a process material in a process apparatus, comprising:

a process gas inlet and a process gas outlet fluidically connected to the process apparatus, wherein the process gas flows on a treatment section extending from the process gas inlet to the process gas outlet;

a process gas dehumidifying device, designed as a device component, in flow direction of the process gas; and a process gas tempering device, designed as a device component, arranged downstream of the process gas dehumidifying device, wherein the process gas dehumidifying device has a dehumidifying device inlet and a dehumidifying device outlet and the process gas tempering device has a tempering device inlet and a tempering device outlet, wherein the process gas tempering device has a tempering unit, designed as a device component, for the process gas having a tempering unit inlet and a tempering unit outlet, a cooling unit, designed as a device component, for the process gas having a cooling unit inlet and a cooling unit outlet, and a bypass unit, designed as a device component, connected in parallel to the tempering unit having a bypass inlet and a bypass outlet, wherein a valve arrangement, designed as a device component, is arranged on the bypass unit for optional throughflow of the tempering unit or the bypass unit, wherein the process gas treatment device further comprises a first measuring device having a relative humidity sensor for measuring the relative humidity of the process gas, wherein the first measuring device is arranged downstream of the process gas dehumidifying device and with a control device, wherein the cooling unit is a constituent of the bypass unit, wherein the process gas treatment device further comprises a process apparatus designed as a fluidized bed apparatus, spouted bed apparatus, or drum coater arranged downstream of the process gas tempering device and is configured to receive the process gas through the process gas outlet, and wherein the process gas treatment device further comprises a humidifying device, designed as a device component, arranged downstream of the process gas dehumidifying device and upstream of the process gas tempering device, which humidifying device has a humidifying device inlet and a humidifying device outlet.

2. The process gas treatment device according to claim 1, wherein the process gas treatment device further comprises a process gas conveying device designed as a device component.

3. The process gas treatment device according to claim 1, wherein the process gas dehumidifying device further comprises a condensation dehumidifying unit, designed as a device component, having a condensation dehumidifying unit inlet and a condensation dehumidifying unit outlet, and/or has an adsorption dehumidifying unit, designed as a device component, having an adsorption dehumidifying unit inlet and an adsorption dehumidifying unit outlet, wherein the condensation dehumidifying unit is arranged upstream of the adsorption dehumidifying unit on the treatment section.

4. The process gas treatment device according to claim 3, wherein the adsorption dehumidifying unit is designed as a drying wheel.

5. The process gas treatment device according to claim 1, wherein the process gas dehumidifying device has a preheating unit, designed as a device component, having a preheating unit inlet and a preheating unit outlet, which preheating unit is arranged upstream of a condensation dehumidifying unit and/or of an adsorption dehumidifying unit of the process gas dehumidifying device.

6. The process gas treatment device according to claim 1, wherein the first measuring device is arranged upstream of the process gas tempering device.

7. The process gas treatment device according to claim 1, wherein the first measuring device comprises a temperature sensor for measuring the temperature of the process gas.

8. The process gas treatment device according to claim 1, wherein the tempering unit comprises a heating device, designed as a device component, having a heating device inlet and a heating device outlet.

9. The process gas treatment device according to claim 1, wherein a process gas conveying device is arranged downstream of the process gas dehumidifying device and upstream of the process gas tempering device.

10. The process gas treatment device according to claim 1, wherein a second measuring device, having a relative humidity sensor for measuring the relative humidity of the process gas, is arranged upstream of the process gas dehumidifying device.

* * * * *